US005712440A

United States Patent [19]

Eagar et al.

[11] Patent Number: 5,712,440

[45] Date of Patent: Jan. 27, 1998

[54] APPARATUS AND PROCESS FOR EXPLOSIVES MIXING AND LOADING

[75] Inventors: Simon Edward Eagar, Beecroft; Andrew David Hunter, Toronto, both of Australia

[73] Assignee: ICI Australia Operations Proprietary Limited, Melbourne, Australia

[21] Appl. No.: 558,242

[22] Filed: Nov. 17, 1995

[30] Foreign Application Priority Data

Nov. 18, 1994 [AU] Australia ..... PM9550

[51] Int. Cl.[6] ..... F42B 3/00; F42D 1/08

[52] U.S. Cl. ..... 86/20.15; 86/21; 102/313

[58] Field of Search ..... 86/20.15, 21; 102/313

[56] References Cited

U.S. PATENT DOCUMENTS 3,068,791 12/1962 Lambert et al. .

3,075,463 1/1963 Eilers et al. .

3,718,088 2/1973 Bearden et al. .

3,943,820 3/1976 Persson ..... 86/20.15

4,003,429 1/1977 Hay et al. ..... 166/51

FOREIGN PATENT DOCUMENTS 119515 5/1970 Norway ..... 86/20.15

*Primary Examiner*—Peter A. Nelson

[57] ABSTRACT

The subject invention relates to an apparatus and process for mixing and delivering an explosives composition. The apparatus for use in the process comprises a main conduit which can be gas pressurised, a means for introducing a solid particulate phase to the main conduit for transportation by the gas and a means for introducing an emulsion phase into said main conduit such that turbulence of the gas in the main conduit causes uniform mixing of the solid particulate phase and the emulsion phase.

21 Claims, 2 Drawing Sheets

APPARATUS AND PROCESS FOR EXPLOSIVES MIXING AND LOADING

Figure 1:
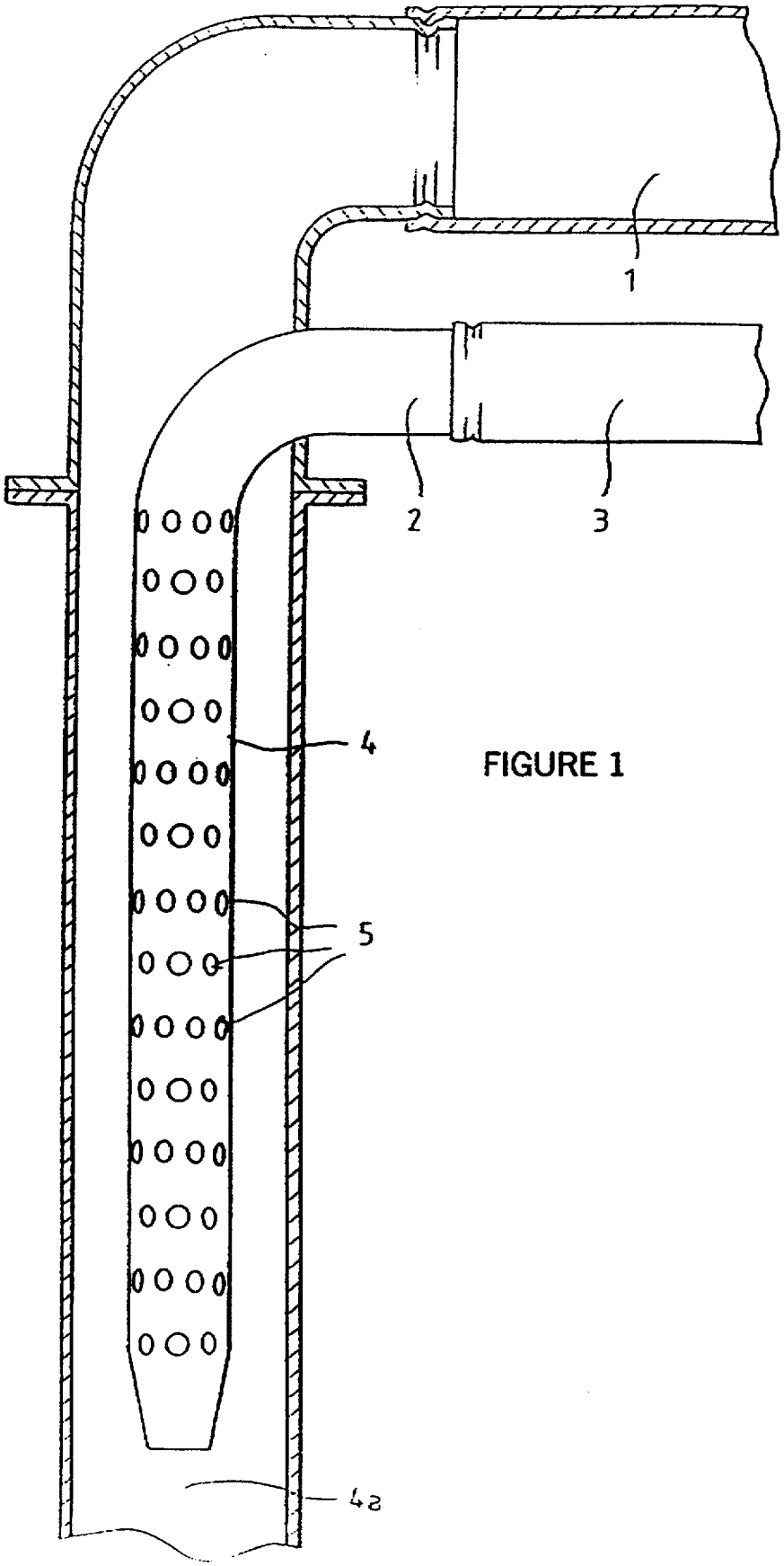

This invention relates to an apparatus and process for preparation of emulsion explosives compositions comprising solid particulate matter and emulsion and delivery of said emulsion explosives to a desired location by blow loading.

Explosive compositions comprising particulate oxidiser salts and a fuel have been known for many years as relatively inexpensive and reliable explosives and the most commonly used of these is ANFO, a mixture of ammonium nitrate (AN) and about 6% w/w fuel oil (FO). However despite its widespread use, ANFO is not very suitable for use in wet conditions because the AN particles absorb water, making the ANFO difficult to detonate and adversely affecting blast performance.

In the past water-in-oil emulsion explosives have been used in wet conditions because of their superior water resistance compared to ANFO, however they are significantly more expensive. Water-in-oil emulsion explosive compositions were first disclosed by Bluhm in U.S. Pat. No. 3,447,978 and comprise (a) a discontinuous aqueous phase comprising discrete droplets of an aqueous solution of inorganic oxygen-releasing salts; (b) a continuous water-immiscible organic phase throughout which the droplets are dispersed and (c) an emulsifier which forms an emulsion of the droplets of oxidiser salt solution throughout the continuous organic phase. They may also include sensitising agents such as a discontinuous gaseous phase.

In order to take advantage of the low cost of ANFO and the superior water resistance of emulsions, ANFO and emulsions have been blended together to provide explosives which are now widely used in the industry and referred to as "heavy ANFO's". Compositions comprising blends of water-in-oil emulsion and AN or ANFO are described, for example in Australian Patent Application No. 29408/71 (Butterworth) and U.S. Pat. Nos. 3,161,551 (Egly et al) and 4,357,184 (Binet et al).

When explosives are used in the mining industry, rock is fractured by drilling blastholes then filling them with bulk or packaged explosive compositions which are subsequently detonated. Where large quantities of bulk explosive are required they are often mixed on-site in manufacturing units located on trucks (called mobile manufacturing units or MMU's) and then loaded into the blastholes.

The MMU's comprise containers in which precursors of explosives compositions are stored separately until being mixed together using a mixing device. For example, MMU's can be used to mix AN and fuel oil to provide ANFO, emulsion and ANFO to provide heavy ANFO. The MMU may also comprise a means for forming the emulsion and Australian Patent No. 42838/85 describes such an MMU which has a blender means for blending an aqueous oxidiser salt solution, emulsifier and liquid organic fuel to form a water-in-oil emulsion.

MMU's also comprise systems for delivery of bulk explosive compositions into blastholes. This is carried out by one of three main methods namely pouring, pumping or blow loading, the method used depending on the type of product. Some compositions have physical characteristics which make them suitable for being poured or augered out of a receptacle on the MMU straight down a blasthole. Pouring is not a suitable delivery method for small diameter holes.

Some compositions are best adapted to being pumped by mechanical or pneumatic means out of the MMU and through a delivery hose into the blastholes. To be pumped an explosive composition must be sufficiently liquid and insensitive to initiation. Emulsion explosives and heavy ANFO's are very dense and viscous and can only be pumped through short hoses; they cannot be pumped through long hoses without the use of excessively high pumping pressures or the hoses simply block up.

Blow loading of an explosive composition typically involves the use of compressed gas to blow the explosive through a delivery hose into blastholes. Blow loading of AN and ANFO has been used since the 1960's and is described in Australian Patent No.s 441775 (Fox), 466558 (Persson), 469494 (Bizon & Simpson) and 474509 (Hay & Fox). Blow loading however has the disadvantage of being limited to AN and ANFO—explosives which can only be used in so called dry holes.

Most mines and quarries have a proportion of blastholes which contain some groundwater ("wet holes") and a proportion of blastholes which contain little or no water ("dry holes"). Optimally ANFO or heavy ANFO are used in dry holes while bulk emulsion or packaged emulsion explosives are used in wet holes.

The limitation of blowloading to dry hole AN and ANFO products has been a constant source of difficulty in the past. Many minesites (particularly quarries) use very small diameter, closely spaced blastholes which are difficult to load by pouring or auguring. In these types of minesites it is preferred that the explosive compositions be delivered by blowloading because the MMU's can be parked to one side of a pattern of blastholes and the long blowloading hoses (typically 15 meters long and 64 millimeters diameter) extended across the blast pattern to load the holes with AN or ANFO.

Problems arise where it is necessary to fill such blastholes with compositions other than AN or ANFO. As previously explained, emulsion explosives and heavy ANFO's are only delivered by pumping through short hoses or auguring. Consequently, MMU's which auger or pump have to be moved onto a blasthole pattern close to the holes to be filled and they may crush and close the blastholes as they drive over them.

The present invention provides a new process by which an explosives composition such as heavy ANFO explosives compositions may be delivered into a blasthole by blow loading process. The present invention therefore provides, a process for mixing and loading an explosives composition comprising an emulsion phase and a solid particulate phase which process comprises transporting a solid particulate phase through a main conduit under gas pressure and introducing said emulsion phase into the main conduit such that turbulence in the conduit causes uniform mixing of the solid particulate phase and emulsion phase.

The current invention also provides an apparatus for mixing and delivering an explosives composition comprising a main conduit which can be gas pressurised, a means for introducing a solid particulate phase to said main conduit for transportation by said gas, and a means for introducing an emulsion phase into said main conduit such that turbulence of the gas in the main conduit causes uniform mixing of the solid particulate phase and emulsion phase.

Furthermore the current invention provides a means for introducing an emulsion phase into a main conduit which is gas pressurised for transporting a solid particulate phase, the means comprising a second conduit having a plurality of orifices and enclosed within the main conduit, said second conduit being adapted at one end to receive a flow of emulsion phase.

In use, emulsion may pass into said second conduit and out through the orifices such that the solid particulate phase and gas passing along said conduit pick up small portions of emulsion from the orifices, the turbulence in the conduit causing uniform mixing of the solid particulate phase and emulsion phase.

In a preferred embodiment the explosives composition formed by the process of the current invention or formed using the apparatus or means of the current invention comprises between 1 and 98% W/W solid particulate phase and more preferably between 20 and 80% W/W of the explosives composition.

In a preferred embodiment the solid particulate phase of the explosives composition comprises at least one inorganic oxygen releasing salt such as ammonium nitrate, calcium nitrate, sodium perchlorate or mixtures thereof. Optionally the solid particulate phase may be mixed with up to 12% hydrocarbon oil. In a particularly preferred embodiment the solid particulate phase is ANFO, comprising between 0.1 and 18.5% w/w fuel oil and from 85 to 99.9% w/w ammonium nitrate.

Where used herein the term emulsion phase refers to a water-in-oil emulsion comprising a continuous water immiscible organic phase, a discontinuous aqueous phase and an emulsifying agent. Typically the oxygen-releasing salt component of the emulsion phase comprises from 45 to 95% w/w and preferably from 60 to 90% w/w of the total emulsion phase.

In the emulsion phase of the compositions preferably all of the oxygen-releasing salt is in aqueous solution. Typically the amount of water employed in the compositions is in the range of from 1 to 30% w/w of the emulsion component. Preferably the amount employed is from 5 to 25% and more preferably from 6 to 20% w/w of the emulsion phase.

Typically the continuous water-immiscible organic phase of the water-in-oil emulsion phase comprises from 2 to 15% w/w and preferably 3 to 10% w/w of the emulsion phase of the composition.

The water-in-oil emulsifying agent component of the composition of the emulsion phase may be chosen from the wide range of emulsifying agents known in the art to be suitable for the preparation of water-in-oil emulsion explosive compositions.

Typically the emulsifying agent component of the composition comprises between 0.5 and 5% w/w of the emulsion phase. Higher proportions of the emulsifying agent may be used and may serve as a supplemental fuel for the composition but in general it is not necessary to add more than 5% by weight of emulsifying agent to achieve the desired effect.

If desired, other optional fuel materials, hereinafter referred to as secondary fuels may be incorporated into the emulsion phase in addition to the water-immiscible organic fuel phase. Typically the optional secondary fuel component of the composition of the emulsion phase comprises from 0 to 30% w/w of the emulsion composition.

Optionally the emulsion phase may be mixed with hydrocarbon oil or other fuel materials. In a preferred embodiment the emulsion phase is mixed with fuel oil prior to mixing with the solid particulate phase. Such blending may be carried out by any suitable blinding apparatus known in the art including static mixing elements.

In a preferred embodiment the device of the current invention has a second conduit which is co-axial with the gas pressurised main conduit for transporting solid particulate matter. The orifices in the second conduit may be of any convenient shape and are preferably offset relative to each other or randomly located along the length of the second conduit. The pattern and size of the orifices are chosen so that the force of gas rushing past and the force of solid particulate matter impacting the second conduit effectively removes small portions of emulsion which emerge through the orifices. The pattern and size of orifices may therefore vary with the viscosity, tackiness and other physical properties of the emulsion. Preferably the orifices are circular in shape and between 3 and 6 millimeters in diameter. The orifices may also be elliptical in shape, preferably with a major axis between 3 and 6 millimeters.

The second conduit is adapted at one end to receive a flow of emulsion and is preferably open at the other end. The emulsion may be caused to flow by any convenient means such as gas pressure or pumping which is sufficient to promote introduction of the emulsion into the second conduit and out through at least some of the orifices. Preferably the emulsion is not forced to the end of the second conduit and the emulsion proceeds no further than 75% of the entire length of the second conduit. In a preferred embodiment the emulsion is delivered from 50 to 85% of the orifices and more preferably the emulsion passes out through 65 to 75% of the orifices.

In a preferred embodiment, the ratio of the length of the second conduit to its diameter is between 15:1 and 6:1.

It is important that the device of the current invention introduces small portions of emulsion into the flow or gas and solid particulate phase in the main conduit such that there is thorough, uniform mixing of the emulsion and solid particulate phase. If the emulsion is supplied into the conduit too quickly the emulsion is merely thrown onto the wall of the conduit by the gas flow where the emulsion may build up and cause a blockage.

In general particularly good mixing of emulsion phase and solid particulate phase can be obtained when the emulsion is at a relatively high temperature, that is between 65° and 85° C. In general the higher the viscosity of the emulsion phase, the more difficult it is to achieve thorough uniform mixing with the solid particulate phase.

It is preferable that each storage container from which any solid particulate ingredients are fed into the pressurised main conduit are protected from pressure in the conduit which may otherwise hinder the feeding of solid ingredients. This can be achieved by any convenient means such as, for example, a rotary valve.

One problem associated with the use of rotary valves and particulate matter such as AN prills is that restrictions may occur in the flow of prill into the feed chamber of the rotary valve causing problems with prill "hang up" and subsequent milling of prill by the metering auger. Hang up may affect between 0.5 and 1% of total AN prill flow. This in turn may cause flow rate variations and generation of AN dust.

In order to overcome this problem a hose or so called "bleed line" may be fitted between the storage container and the return side of the rotary valve to minimise hang up of the solid particulate matter. This hose or bleed line, bleeds off air and any trapped prill, thereby creating an unrestricted passage of prill into the feeding chamber of the rotary valve.

Once the emulsion is mixed with the solid particulate phase the flow of gas through the pressurised main conduit transports the mixture through the conduit and into a blasthole. To avoid blowback of gas and product from the blasthole and raising of dust as pressurised gas leaves the end of the conduit, a cyclone can be positioned in the conduit to remove gas. Preferably the cyclone is located in the conduit so that in use it is at a position near the collar of the blasthole, but not within the blasthole. The cyclone is located such that the prill/emulsion mix cannot be blown out of the cyclone and only the pressurised gas passes through the cyclone. This can usually be achieved by locating the entrance to the cyclone in a position which is offset relative to the flow path of the prill/emulsion mix.

A preferred embodiment of the process and device of the current invention will now be further described with reference to mixing and delivery of a heavy ANFO explosive composition into a blasthole as shown in the drawings.

Figure 2:
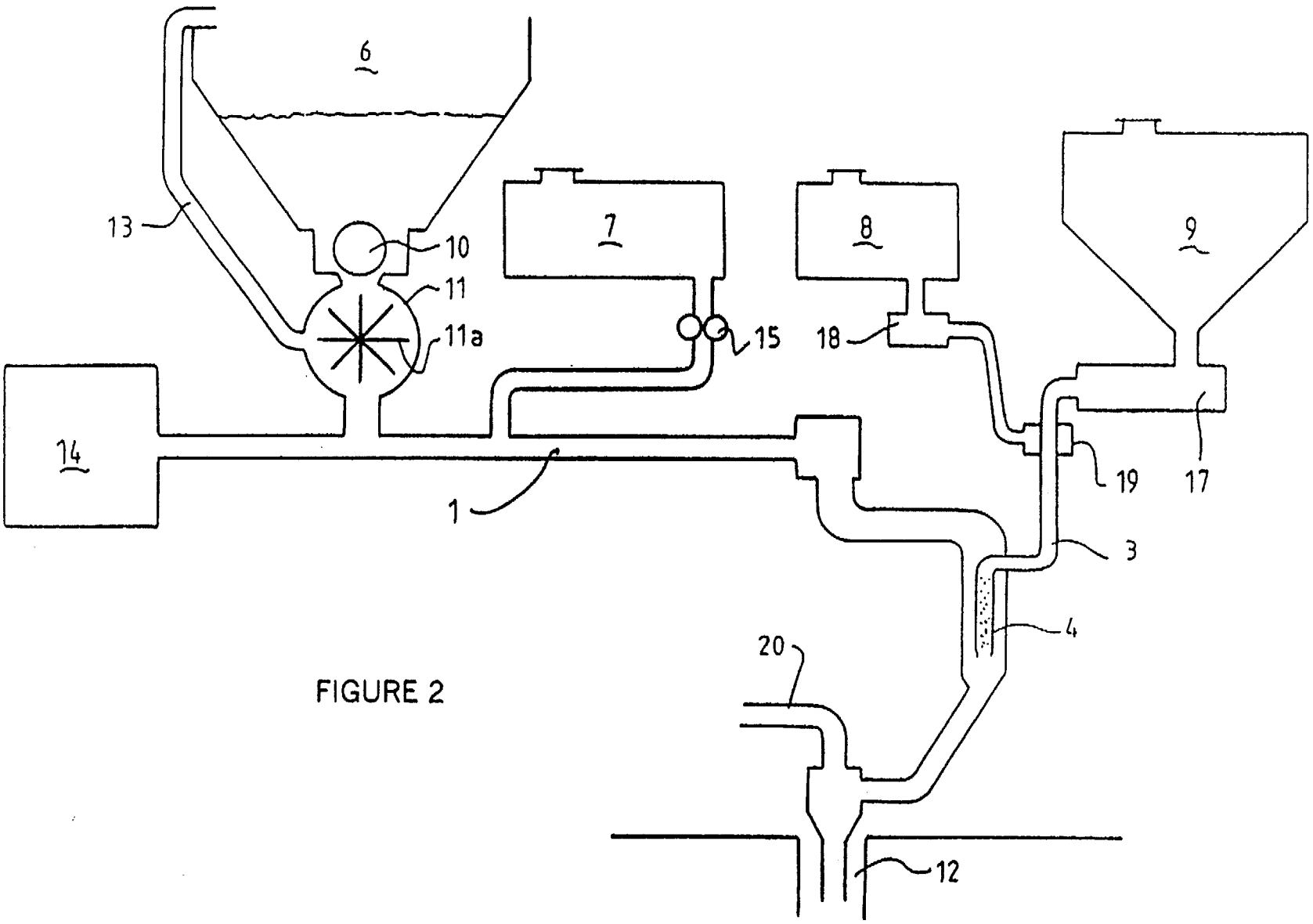

FIG. 1 is a section view of an embodiment of a device of the current invention; FIG. 2 is a schematic diagram of in situ explosives manufacture and delivery using the process of the current invention and the device of FIG. 1.

FIG. 1 shows a conduit (1) for the passage of pressurised gas and solid particulate matter. The conduit is provided with a port (2) to which is connected a hose (3) through which emulsion may be pumped. The emulsion passes through the hose and port into a second conduit (4) which is open at one end (4*a*) and has multiple orifices (5) which are offset relative to one another along the length of the second conduit. The ratio of the length of the second conduit to its diameter is approximately 10:1 and the opening (4*a*) is approximately half the diameter. Portions of emulsion passing out through the orifices are picked up by the gas and solid particulate matter rushing along the conduit.

The embodiment depicted in FIG. 2 utilises a mobile manufacturing unit for transport of explosives precursors and in situ manufacture of explosives compositions. The vehicle carries four containers—a storage container for the solid particulate matter (6) a storage container for fuel oil (7), a water container (8) for facilitating water injection pumping and an emulsion tank (9). The solid particulate matter comprising AN prills is moved from the storage container by means of an auger (10) located internally in the storage container. The prills pass into the feed chamber of a rotary valve (11) and then into a rotary valve (11*a*) which disperses the prills into a conduit (1) through which air is passed at high pressure by a blower (14). An air bleed line (13) passes from the rotary valve back to the storage container for solid particulate matter. As the AN prills pass along the conduit they mix with fuel oil which is passed from the fuel oil tank into the conduit by a fuel pump (15). The ANFO thus formed is blown past the second conduit (4) of the device of FIG. 1 where emulsion is introduced into the stream of gas and particles of ANFO. Emulsion from the emulsion tank is pushed into the second conduit by the emulsion pump (17). Water from the water tank is moved by a pump (18) into a water injector (19) located in the emulsion hose (3). The water injection reduces the pressure required to pump the emulsion into the second conduit. The turbulence caused by pressurised gas and solid particulate matter passing along the conduit causes the emulsion and ANFO to thoroughly mix. The mixture is passed along the conduit and loaded into the blasthole (12).

A cyclone (20) or a vent or other similar device can be used to remove at least some of the air used for conveying the AN prills and ANFO along the conduit.

The process of the current invention is exemplified by but not limited to the following example.

EXAMPLE 1

An explosive composition comprising an emulsion phase (18.5% w/w) prilled AN and fuel oil (4.9% w/w) was prepared and delivered into blastholes by the process of the current invention. The solid particulate matter was supplied to a pressurised main conduit by an auger which was used to meter the AN into a Chemplant 200 rotary feeder. Air flow in the conduit was maintained at 430 $m^3$/hr by a Peabody Holmes blower. Fuel oil was injected into the flow of AN prills and the ANFO so formed was blown past the second conduit of the device of FIG. 1 to form a uniform mixture of ANFO and emulsion. The heavy ANFO so prepared was blown along the main conduit into blastholes at a rate of 70 kg/min. The main conduit comprised a hose of 19 meters in length and 64 millimeter internal diameter. The composition was blown out of the main conduit into blastholes of 76 mm and 89 mm diameter and up to 20 meters depth. All holes detonated successfully.

EXAMPLE 2

An explosive composition comprising an emulsion phase (12% w/w of the composition) and a particulate phase consisting of prilled ammonium nitrate and particulate calcium nitrate was prepared and delivered into blastholes by the process of the current invention. The particulate phase was supplied to a pressurised conduit by an auger which was used to meter the prills and particles into a Chemplant 200 rotary feeder. Air flow in the conduit was maintained at 480 $m^3$/hr by a Peabody Holmes blower. The ammonium nitrate prills and calcium nitrate particles were blown past the second conduit of the device of FIG. 1 to form a uniform mixture of particulate phase and emulsion. The explosive composition so prepared was blown along the conduit and into blastholes at a rate of 60 kg/min. The main conduit was 15 meters in length and of 72 millimeters internal diameter. The blastholes were of 89 mm or 102 mm in diameter and up to 10 meters depth. All holes detonated successfully.

While the current invention relates to an apparatus and process for preparation of emulsion explosives compositions it could also be used to disperse any fluid having theological properties similar to that of water-in-oil emulsion explosive compositions. For example the current process could be used for mixing particles of dried fruit, desiccated coconut or the like and yoghurt.

While the invention has been explained in relation to its preferred embodiments it is to be understood that various modifications thereof will become apparent to those skilled in the art upon reading the specification. Therefore it is to be understood that the invention disclosed herein is intended to cover such modifications as fall within the scope of the appended claims.

We claim:

1. An apparatus for mixing and delivering an explosives composition comprising a main conduit which can be gas pressurised, a means for introducing a solid particulate phase to said main conduit for transportation by said gas, and a means for introducing an emulsion phase into said main conduit such that turbulence of the gas in the main conduit causes uniform mixing of the solid particulate phase and emulsion phase, wherein the means for introducing the emulsion phase into the main conduit comprises a second conduit having a plurality of orifices and enclosed within the main conduit, said second conduit being adapted at one end to receive a flow of emulsion phase.

2. A process for mixing and delivering an explosives composition comprising an emulsion phase and a solid particulate phase which process comprises transporting a solid particulate phase through a main conduit under gas pressure and introducing said emulsion phase into the main conduit such that turbulence in the conduit causes uniform mixing of the solid particulate phase and emulsion phase, wherein the means for introducing the emulsion phase into the main conduit comprises a second conduit having a plurality of orifices and enclosed within the main conduit, said second conduit being adapted at one end to receive a flow of emulsion phase.

3. An apparatus for mixing and delivering an explosives composition according to claim 1 wherein the second conduit is co-axial with the main conduit.

4. An apparatus for mixing and delivering an explosives composition according to claim 1 wherein the orifices are circular in shape and between 3 and 6 millimeters in diameter.

5. An apparatus for mixing and delivering an explosives composition according to claim 1 wherein the second conduit is open at the end which does not receive the flow of emulsion phase.

6. An apparatus for mixing and delivering an explosives composition according to claim 1 wherein the emulsion phase proceeds no further than 75% of the entire length of the second conduit.

7. An apparatus for mixing and delivering an explosives composition according to claim 1 wherein the emulsion phase is delivered into the flow of gas in the main conduit, using 50 to 85% of the orifices.

8. An apparatus for mixing and delivering an explosives composition according to claim 1 wherein the emulsion phase is delivered into the flow of gas in the main conduit, using 65 to 75% of the orifices.

9. An apparatus for mixing and delivering an explosives composition according to claim 1 wherein the ratio of the length of the second conduit to its diameter is between 15:1 and 6:1.

10. An apparatus according to claim 1 which further comprises a cyclone for escape of gas from the main conduit.

11. A means for introducing an emulsion phase into a main conduit which is gas pressurised for transporting a solid particulate phase, the means comprising a second conduit having a plurality of orifices and enclosed within the main conduit, said second conduit being adapted at one end to receive a flow of emulsion phase.

12. A means for introducing an emulsion phase into a main conduit according to claim 11 wherein the orifices are circular in shape and between 3 and 6 millimeters in diameter.

13. A means for introducing an emulsion phase into a main conduit according to claim 12 wherein the orifices are elliptical in shape and have a major axis between 3 and 6 millimeters.

14. A means for introducing an emulsion phase into a main conduit according to claim 11 wherein the ratio of the length of the second conduit to its diameter is between 15:1 and 6:1.

15. A means for introducing an emulsion phase into a main conduit according to claim 11 wherein the orifices are offset relative to each other.

16. An explosive composition prepared by the process of claim 2 comprising between 20 and 80% w/w solid particulate phase.

17. A process according to claim 2 comprising the steps of;

(a) supplying solid particulate matter from a storage container to a pressurised main conduit, (b) transporting said solid particulate matter along the main conduit under the gas pressure, past a second conduit such that turbulence in the conduit causes emulsion phase passing through orifices in the second conduit to mix with said solid particulate matter, and (d) transporting said mixture of solid particulate matter and emulsion phase along the main conduit under gas pressure into a blasthole.

18. A process according to claim 2 wherein the solid particulate phase comprises at least one inorganic oxygen releasing salt.

19. A process according to claim 18 wherein the solid particulate phase comprises ammonium nitrate prills.

20. A process according to claim 2 wherein the solid particulate phase further comprises up to 12% w/w of hydrocarbon oil.

21. A process according to claim 2 wherein said solid particulate matter is fed from said storage container into the pressurised main conduit by a rotary valve and a bleed line passes between the storage container and the return side of the rotary valve.

* * * * *